US005421478A

United States Patent [19]

Lovato

[11] Patent Number: 5,421,478

[45] Date of Patent: Jun. 6, 1995

[54] STORAGE TANK AND BAFFLE

[76] Inventor: Wilbur Lovato, 225 El Paso Dr., Farmington, N. Mex. 87401

[21] Appl. No.: 47,431

[22] Filed: Apr. 15, 1993

[51] Int. Cl.[6] ..... B65D 90/00

[52] U.S. Cl. ..... 220/565; 220/469

[58] Field of Search ..... 220/565, 563, 469, 4.12; 138/42

[56] References Cited

U.S. PATENT DOCUMENTS

| | | | |
|---|---|---|---|
| 3,954,124 | 5/1976 | Self | 138/42 |
| 4,374,478 | 2/1983 | Secord et al. | 220/565 X |
| 4,567,915 | 2/1986 | Bates et al. | 138/42 |
| 4,638,920 | 1/1987 | Goodhues, Jr. | 220/565 X |
| 4,840,283 | 6/1989 | Lillywhite et al. | 220/469 X |
| 4,921,014 | 5/1990 | Tartaglia et al. | 138/42 X |
| 4,934,553 | 6/1990 | McCarthy | 220/469 X |
| 5,016,689 | 5/1991 | McGarvey | 220/469 X |
| 5,165,569 | 11/1992 | Furuhashi et al. | 220/469 X |

*Primary Examiner*—Steven M. Pollard
*Attorney, Agent, or Firm*—Hoffman, Wasson & Gitler

[57] ABSTRACT

The present invention relates to a storage tank for storing liquid products such as petroleum byproducts and toxic waste, that has an inner and outer tank. The inner tank holds the liquid, while the second tank is provided to protect the surrounding environment. Apparatus may be provided to detect moisture between the two tanks. Apparatus may be provided to prevent liquid in the inner tank from freezing. A roof is provided over the inner tank to reduce the risk of precipitation mixing with the liquids in the tank, and to increase safety of any animals or humans venturing near the tanks. A baffle is provided to reduce the pressure of any liquid entering the tank to reduce the risk of damage to the inner tank and prolong the life thereof. A vent is provided to allow vapors to escape to the atmosphere.

16 Claims, 6 Drawing Sheets

STORAGE TANK AND BAFFLE

BACKGROUND OF THE INVENTION

The present invention relates to a storage tank, and in particular to a storage tank for containing hazardous or harmful liquids to prevent contamination of the surrounding environment.

A variety of tanks are currently used to store petroleum products and toxic chemicals, such as those listed in the Environmental Protection Agency's Hazardous Substance list. Commonly, the storage tank is made from steel plate and is buried in the ground. However, such tanks are a major cause of pollution of the water table as the tanks lack proper corrosion protection, leak detection, and spill prevention. Liquid byproducts from oil well exploration and development are often piped into storage tanks for temporary storage until the liquid can be moved to a permanent storage facility. These tanks are normally a single wall construction of steel or fiberglass located in the ground with the top exposed to the elements. Debris can collect in the tank and animals and/or humans may fall into the tank. Another drawback is that in the event of an overflow, the toxic chemicals can contaminate the surrounding environment. The liquid byproducts are conveyed under pressure at approximately around 500 psi. Such pressure can damage the tank and/or result in streams of liquid being forced into the surrounding environment.

Accordingly, it is an object of the present invention to provide an in-ground storage tank which prevents contamination of the surrounding environment.

It is a further object of the present invention to provide a storage tank which has a double-hull design to resist corrosion of the tank and thereby limit contamination of the water table.

It is another object of the invention to provide a storage tank which reduces the risks to humans and animals from falling into the tank.

Yet another object of the invention is to provide a storage tank that reduces the pressure of liquid entering the tank to reduce damage to the tank and minimize turbulence.

These and other objects and advantages will become more apparent from the following description and drawings in which like reference numerals depict like elements.

SUMMARY OF THE INVENTION

The present invention relates to a double walled storage tank which includes an inner tank for containing the materials, and an outer tank for containing any spills from the inner tank. The inner tank can be unbolted and removed from the outer tank for repair or replacement. The entire structure is intended to be sunk into the ground and covered by a steel roof to prevent matter from escaping from the tank and to prevent foreign objects or animal life from falling into the tank. The tanks may include a moisture detecting device for detecting moisture between the inner and outer tanks. A baffle is provided to reduce the pressure of the liquid from around 500 psi to approximately 150 psi, and thereby reduce damage to the inside of the inner tank and lower the chance of any matter being ejected from the structure to surrounding areas.

BRIEF DESCRIPTION OF THE DRAWINGS

FIG. 1 is a side view of a storage tank according to

DETAILED DESCRIPTION OF THE PREFERRED EMBODIMENT

Figure 1:
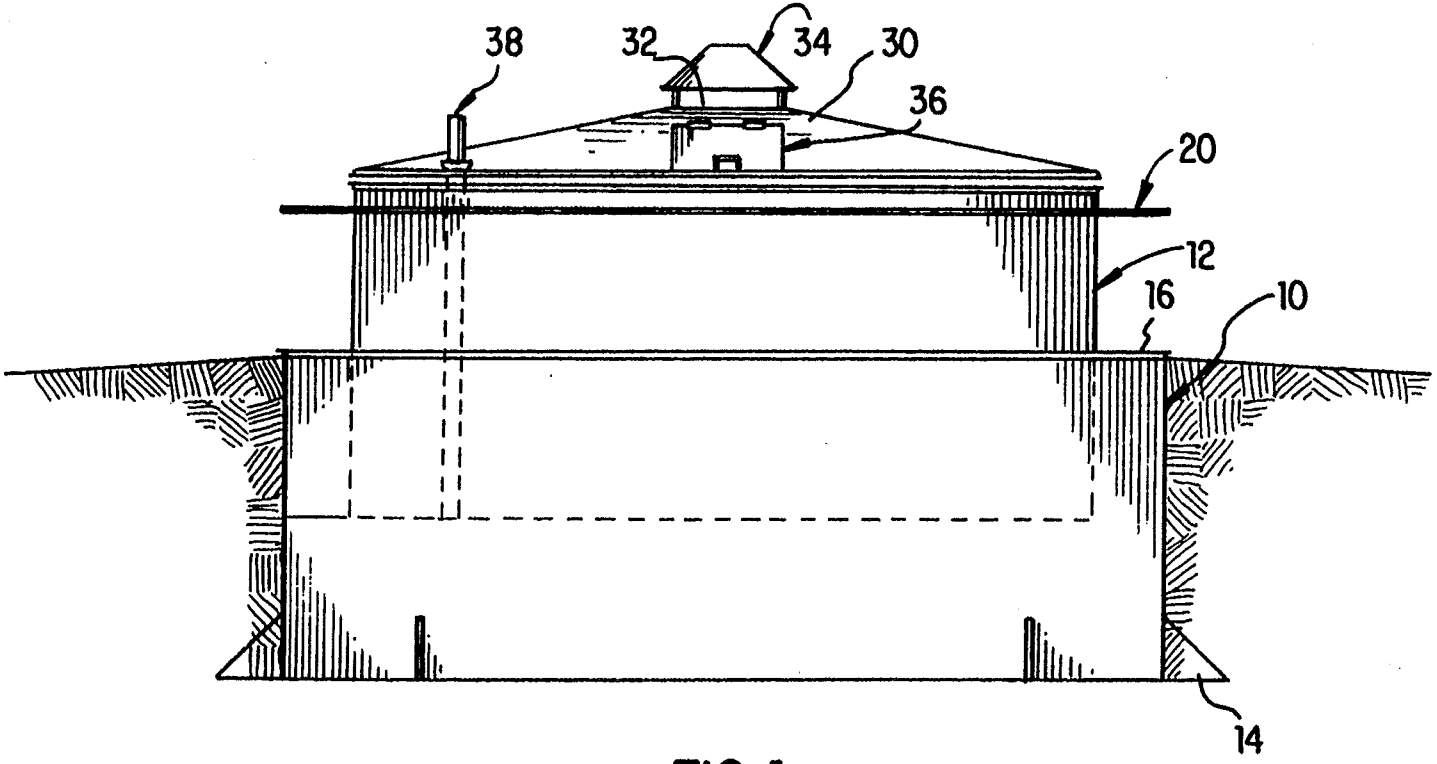
Figure 2:
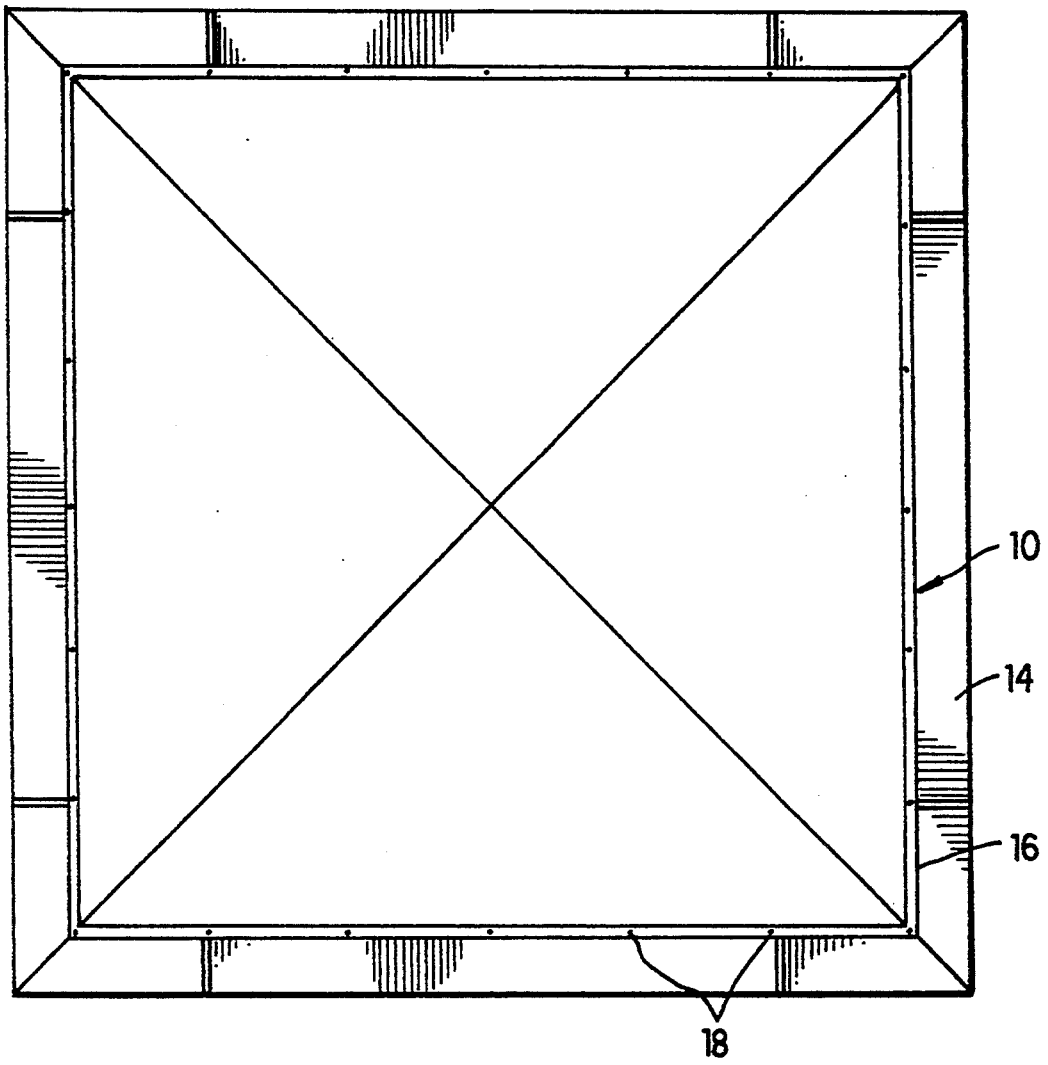
FIG. 2 is a top plan view of the outer tank shown in FIG. 1.
Figure 3:
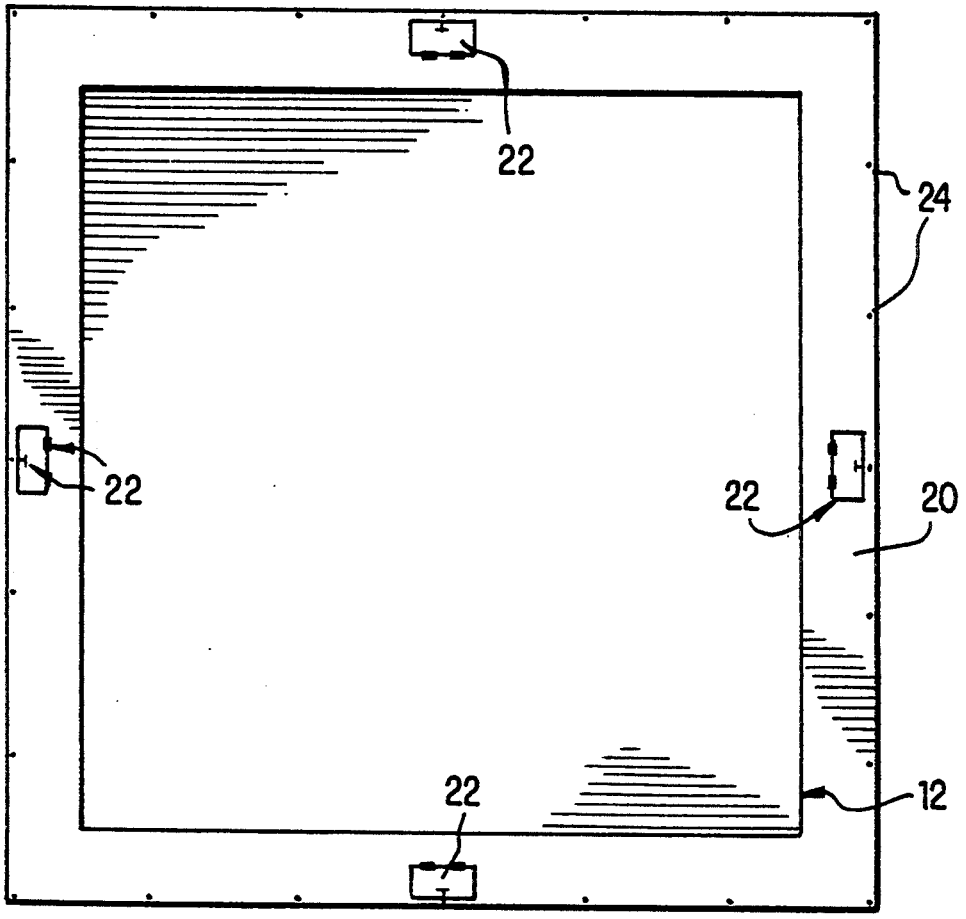
FIG. 3 is a top plan view of the inner tank of the embodiment shown in FIG. 1.

Referring to FIGS. 1–4, the present invention pertains to a storage tank having an outer tank 10 and an inner tank 12. As shown in FIG. 1, the outer tank 10 is built so that it is buried in the ground with its upper edge substantially parallel to the surrounding land. The soil surrounding the tank is compacted so that it slopes away from the tank to assist in drainage in the event of precipitation to thereby reduce accumulation of liquid around the tank, and thus lower the risk of corrosion of the tank.

Figure 7:
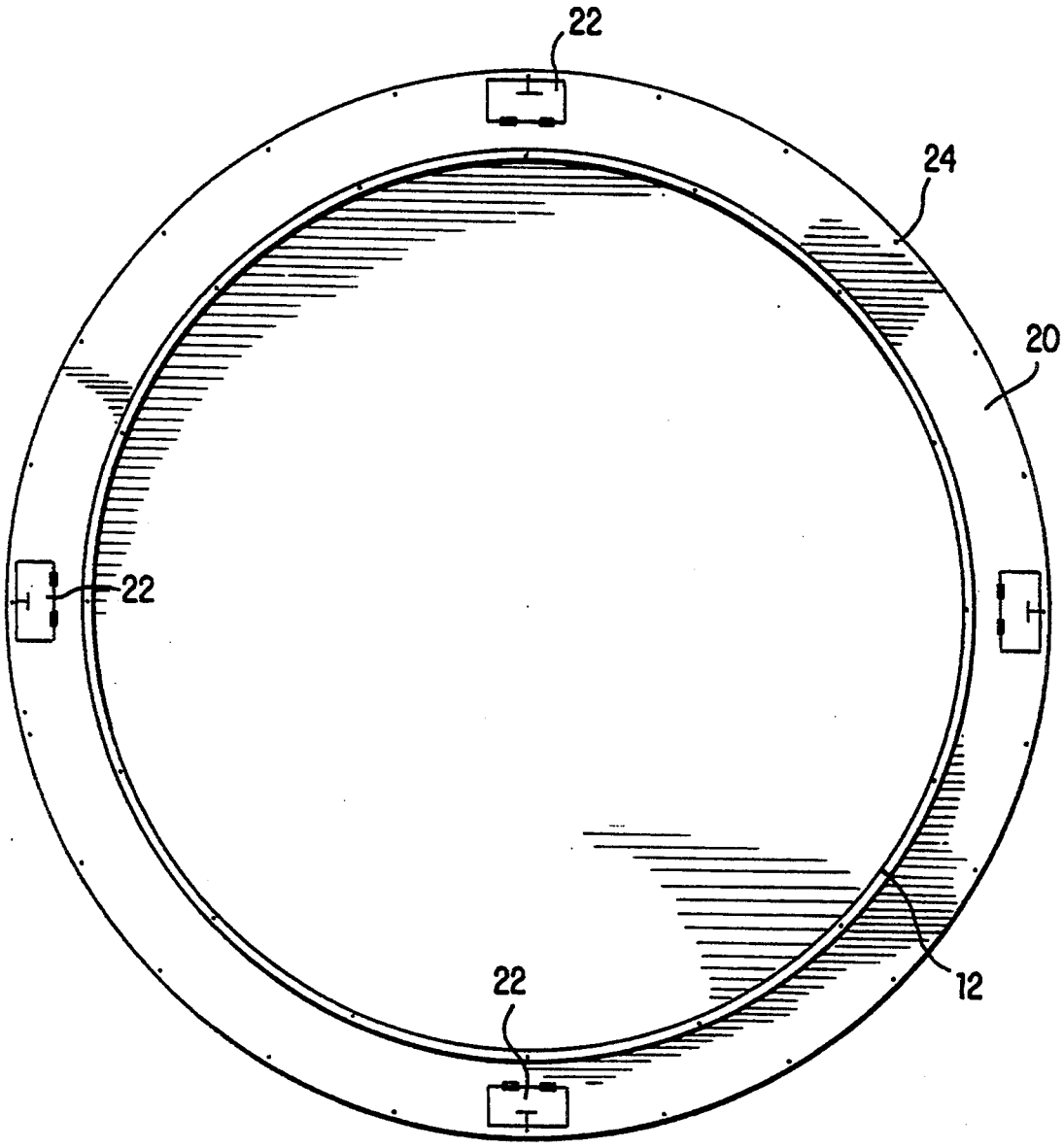
FIG. 7 is a top plan view of the inner tank having a circular configuration.

The outer tank is made from steel, and preferably 3/16" thick sheet steel. While the FIGS. 1–5 show a square storage tank, other geometrical configurations are possible such as circular, hexagonal, triangular, etc. For example, FIG. 7 shows an inner tank with a circular configuration. A 3/16" plate gusset 14 is provided around the base of the outer tank 10 to add stability and serves as an anchor when the tank 10 is buried. The upper edge 16 of the outer tank 10 has holes 18 provided around its periphery.

The inner tank 12 is also made from 3/16" sheet steel, and has an upper lip 20 around its periphery. A series of inspection doors 22 provided in the lip 20. The lip 20 also has a series of holes 24 corresponding to holes 18 in the upper edge of the outer tank 10. The inner tank 12 is bolted to the outer tank by bolts (not shown) which extend through the holes 24 and 18. In this manner, the inner tank 12 is properly spaced inside of the outer tank 10 so that all the walls of the inner tank 10 are spaced equally from corresponding walls of the outer tank 12. Once the inner tank 12 has been properly connected to the outer tank, inspection of the space between the two tanks is performed through the inspection doors 22.

In the event that there is damage to the inner tank 12, or for periodic inspection, it is a simple matter to unbolt the bolts extending through holes 24 and 18 and raise the inner tank 12 out of the outer tank 10.

Figure 4:
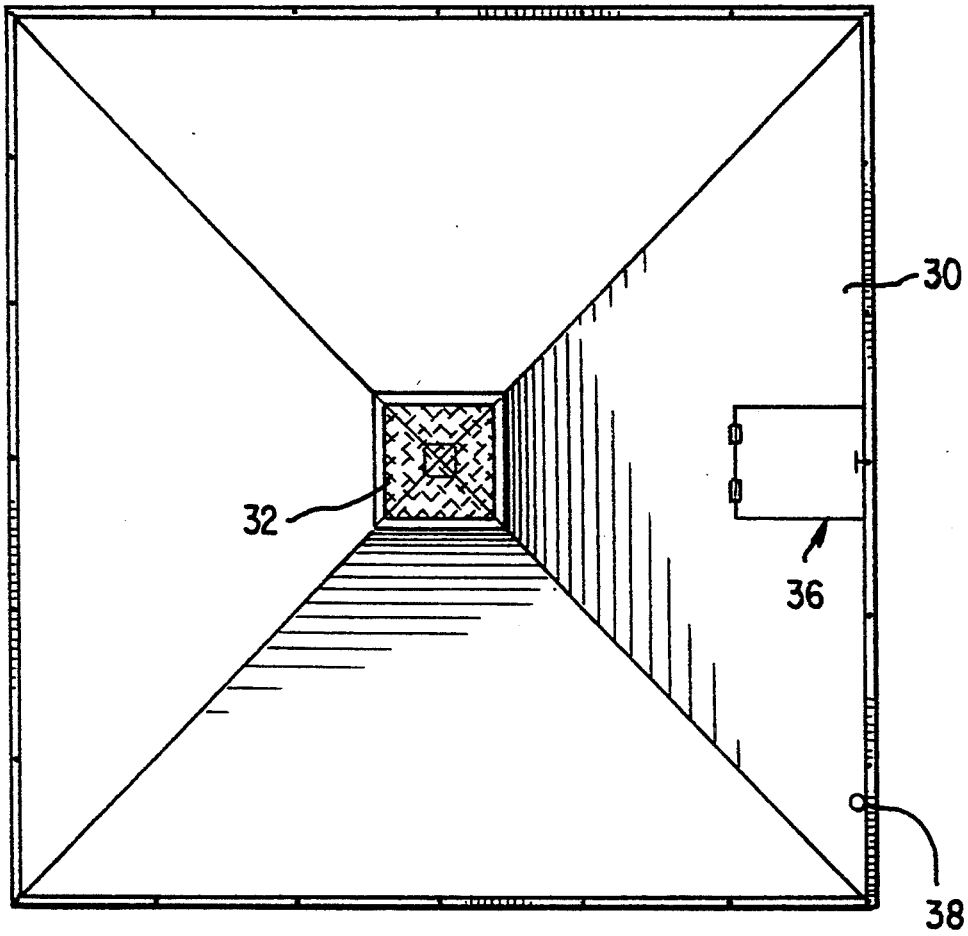
FIG. 4 is a upper view of the cover or roof of the embodiment shown in FIG. 1.

As shown in FIGS. 1 and 4, a roof or cover 30 is provided, which attaches to the inner tank 10. A vent 32 is provided in the center of the roof 30, and the vent 32 is provided with a separate cover 34 which is positioned slightly above the vent 32 to allow air to flow through the vent. An access door 36 is provided in the roof 32 to permit access to the inside of the inner tank. A load line 38 extends through the roof 30 into the inner tank 10. The cover or roof 30 prevents precipitation, foreign objects and animal life from falling into the inner tank 10 and coming into contact with toxic waste contained therein.

The foregoing construction has significant advantages over the conventional tanks presently used. For instance, present tanks are usually of a single wall construction, and in the event of the failure of that container, toxic chemicals, petroleum products, etc. can seep into the surrounding soil and make its way to the water table. Furthermore, many of these tanks have no provision for protecting animal life or foreign objects for falling into the tanks. It is a common sight to see a storage tank in which all surrounding wildlife is dead.

The storage tank of the present invention is intended as a temporary storage tank. Thus, once the toxic waste has been stored in the tank for whatever required period of time, it is a simple matter to bring a tanker or other vehicle to the site and pump the toxic waste through the load line 38 to the vehicle to remove the toxic waste and take it to a permanent storage site.

While the present design includes the doors 22 to provide inspection of the area between the tanks for signs of leakage and/or corrosion, the design can easily be modified to provide for electronic moisture sensors, which can be connected to an electronic transmitter, and powered by a battery, solar energy or power line, to send signals to a central location which would indicate the presence of moisture in the space between the two tanks. A heater could also be provided of a kind commonly employed in oil fills where natural gas flame is directed through a pipe circling through the inner tank to keep any liquid in the inner tank from freezing.

In the embodiment shown in FIGS. 1–4, the vent 32 permits the evaporation of volatile materials or water. As an alternative version of the roof, a frame or mesh could be welded to the roof to allow for faster evaporation of volatile materials or water by increasing the area of such a vent to increase such evaporation.

Another drawback to conventional tanks is that there is no provision for dealing with overflow. In those tanks, since they are open to the environment, rain or precipitation can fill the tank causing an overflow which contaminates the surrounding environment. In the present invention, the roof protects the tank from the mixing with external matter, thus reducing the risk of any overflow.

Figure 5:
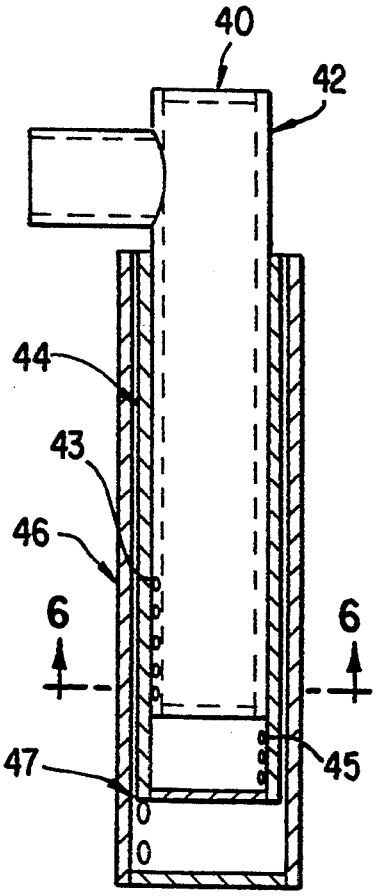
FIG. 5 is a side view of a baffle of the present invention.

Referring to FIG. 5, the tank of the present invention is provided with a baffle which is attached to the plumbing to bring materials into the tank. This baffle reduces pressures from 500 to 600 psi, commonly found in gas field operations, to approximately 100 to 150 psi. Simultaneously, the liquid is converted into a mist, rather than a stream of high pressure water, reducing damage to the inside of the tank. This reduces the chance of any matter being ejected from the structure to sensitive areas, and the mist allows for rapid evaporation.

The baffle 40 is connected between an oil or gas well and the tank, so that when a pumper of a well (preferably of gas or oil) blows off the separator or wellhead line to clear it of oils, carbons, and liquids, when the pressure hits the baffle, the pressure is bled off slowly without a geyser effect, thus keeping all contaminants in the tank. Thus, no overspray or splashing of liquids out of the tank occurs, which would result in expensive clean-up procedures.

Figure 6:
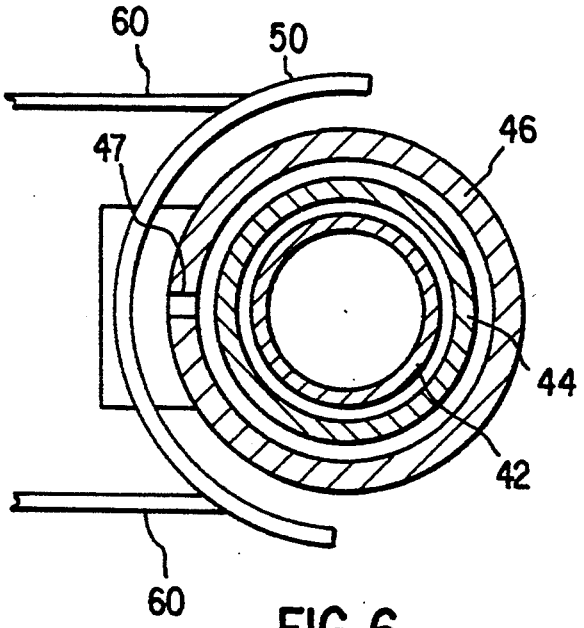
FIG. 6 is a cross-sectional view of the baffle taken along line 6—6 of FIG. 5.

The liquid under pressure goes through three chambers so that the pressure is reduced from the 500 to 600 psi and the liquid is initially under to the approximately 100 to 250 psi that the liquid is under when it comes out the third chamber. Referring to FIGS. 5 and 6, the first chamber 42 is cylindrical and has a series of approximately ⅜" holes 43 every four inches from the top of the chamber to the bottom. These holes 42 are along one side of the chamber. A second cylindrical chamber 44 surrounds the first chamber 42 and has similar ⅜" holes 45 formed on the side opposite the ⅜" holes 43 in the first chamber 42 and are spaced approximately every three inches from top to bottom. Finally, a third cylindrical chamber 46 surrounds the second chamber 44 and has ½" holes 47 every two inches, with the holes being formed on the same side of the chamber 46 as the holes 43 in the first chamber 42. This alternating hole formation reduces the pressure of the liquid entering the baffle. There is an approximately ¼" gap between the first chamber 42 and the second chamber 44, as shown in FIG. 5. An approximate ½" gap is provided between the outer wall of the second chamber 44 and the inner wall of the third chamber 46.

Finally, as shown in FIG. 6, a semicircular plate 50 is provided concentrically about the outer wall of the third chamber 46, so that any liquids exiting from the ¼" holes 47 formed in the third chamber 46, hit the semi-cylindrical plate 50. This plate 50 is connected to the inner wall of the inner tank 10 by supports 60, so that it extends into the tank 10, and is securely held in position to protect the wall of the tank 10 from any damage which might be caused by liquid flowing out of the baffle 40. The semi-cylindrical plate 50 helps to disperse the pressurized fluids, and also helps to eliminate any geysering or overspray out of the tank into the surrounding environment. If the fluid were allowed to flow directly into the inner tank 10, serious damage could result to the walls of the inner tank 10, as the result of continuous input of liquid. In other words, as the fluid continually hits the same spot along the inner wall of the inner tank 10, a weakening of that wall could occur, due to the high pressure of the fluid flowing into the tank. By reducing the pressure of the fluid through the baffle, and by eliminating direct contact of the liquid under pressure with the inner tank wall, such risk is reduced. Furthermore, the semi-cylindrical plate helps increase the amount of misting of such liquid, thereby reducing the risk of any damage.

While the foregoing invention has been described in combination with the specific embodiments, it is evident that many alternatives, modifications and variations will be apparent to those skilled in the art in light of the foregoing description. Accordingly, it is intended for the following claims to embrace such alternatives, modifications, and variations as fall within the spirit and broad scope thereof.

What is claimed is:

1. A storage tank for storing liquids, comprising:

an outer tank which is buried in the ground;

an inner tank disposed in said outer tank; and means for centering said inner tank in said outer tank, said centering means consisting of a lip projecting outwardly from walls of said inner tank, and means for connecting said lip to said outer tank, so that said inner tank is suspended in said outer tank with said walls of said inner tank being disposed equidistant from corresponding walls of said outer tank, and a bottom of said inner tank being spaced from a bottom of said outer tank.

2. A storage tank as recited in claim 1, wherein said outer tank has holes formed on the upper edge of said tank;

said lip having holes formed therein corresponding to said holes formed in said upper edge of said outer tank so that bolts may be provided through said holes in said lip and said holes in said upper edge, to connect said inner tank to said outer tank, and to allow removal of said inner tank to inspect said inner tank.

3. A storage tank as recited in claim 2, wherein said lip has at least one door to permit inspection of a space between said inner tank and said outer tank.

4. A storage tank as recited in claim 1, further comprising a means for detecting moisture between said inner tank and said outer tank.

5. A storage tank as recited in claim 1, further comprising a means for providing heat to said liquids in said inner tank to prevent said liquids from freezing.

6. A storage tank as recited in claim 1, wherein said means for reducing pressure is a baffle.

7. A storage tank as recited in claim 6, wherein said baffle is a multi-chamber device, so that the pressure of liquid entering said baffle decreases stepwise as it goes from chamber to chamber.

8. A storage tank as recited in claim 7, wherein said baffle comprises multiple concentric chambers, so that liquid enters through an innermost chamber and works its way through the outermost chamber before entering said inner tank.

9. A storage tank as recited in claim 8, wherein said baffle has three chambers.

10. A storage tank for storing liquids, comprising:

an outer tank which is buried in the ground;

an inner tank disposed in said outer tank;

means for reducing pressure of liquid flowing into said inner tank, said means for reducing pressure being multi-chamber baffle, so that pressure of liquid entering said baffle decreases stepwise as it goes from chamber to chamber, said baffle comprising concentric chambers so that liquid enters through an innermost chamber and works it way through the outermost chamber before entering said inner tank, said baffle having three chambers wherein said innermost chamber has a series of first holes formed exclusively on a first side of said innermost chamber, said innermost chamber being surrounded by a second chamber, said second chamber having a series of second holes formed exclusively on a side opposite said side of said innermost chamber having said first holes, said second chamber being surrounded by an outer chamber, said outer chamber having a series of third holes, formed exclusively on a side of said outer chamber opposite said side of said second chamber having said second holes.

11. A storage tank as recited in claim 10, wherein said first holes and said second holes are $\frac{3}{8}''$ diameter holes, and said third holes are $\frac{1}{2}''$ diameter holes.

12. A storage tank as recited in claim 10, wherein said three chambers are all cylindrical, wherein an outer diameter of said inner-most chamber is substantially equal to an inner diameter of said second chamber, and wherein said outer diameter of said second chamber is somewhat less than an inner diameter of said outer chamber, to provide a gap between said second chamber and said outer chamber.

13. A storage tank as recited in claim 10, further comprising a semi-cylindrical plate positioned around said outer chamber, so that liquid escaping through said third holes comes into contact with said semi-cylindrical plate to protect said inner tank.

14. A storage tank as recited in claim 1, further comprising a means for entering said inner tank to inspect said inner tank.

15. A storage tank as recited in claim 1, further comprising mean for removing liquid from said inner tank.

16. A storage tank as recited in claim 1, further comprising:

a roof covering said inner tank, said roof having a vent permitting the evaporation of volatile fumes and evaporation of liquid;

means for permitting access to space between said inner and outer tanks; and means for reducing pressure of liquid flowing into said inner tank.

* * * * *